US009169633B2

(12) United States Patent
DiGregory

(10) Patent No.: US 9,169,633 B2
(45) **Date of Patent: *Oct. 27, 2015**

(54) FOLDABLE TRANSPORTABLE STRUCTURE

(71) Applicant: Vincent J DiGregory, Albuquerque, NM (US)

(72) Inventor: Vincent J DiGregory, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/065,648

(22) Filed: Oct. 29, 2013

(65) Prior Publication Data

US 2014/0047778 A1 Feb. 20, 2014

Related U.S. Application Data

(63) Continuation-in-part of application No. 13/068,430, filed on May 11, 2011, now Pat. No. 8,555,559.

(51) Int. Cl.

| | |
|---|---|
| ***E04H 1/00*** | (2006.01) |
| ***E04B 1/343*** | (2006.01) |
| ***E04B 1/344*** | (2006.01) |
| ***E04B 1/19*** | (2006.01) |
| ***A44B 18/00*** | (2006.01) |
| ***E04B 1/61*** | (2006.01) |
| ***E04B 1/68*** | (2006.01) |
| ***B25B 25/00*** | (2006.01) |

(52) U.S. Cl.

CPC ..... *E04B 1/34384* (2013.01); *A44B 18/0069* (2013.01); *B25B 25/00* (2013.01); *E04B 1/19* (2013.01); *E04B 1/344* (2013.01); *E04B 1/3445* (2013.01); *E04B 1/34357* (2013.01); *E04B 1/54* (2013.01); *E04B 1/68* (2013.01); *Y10T 16/525* (2015.01); *Y10T 24/2175* (2015.01); *Y10T 24/2708* (2015.01); *Y10T 403/70* (2015.01)

(58) Field of Classification Search

CPC ..... E04B 1/34384; E04B 1/34357
USPC ..... 52/79.5, 71, 66; 153/137
See application file for complete search history.

(56) References Cited

U.S. PATENT DOCUMENTS

| | | | | |
|---|---|---|---|---|
| 3,386,209 | A | 6/1968 | Starcevic | |
| 3,420,003 | A | 1/1969 | Cline | |
| 3,905,548 | A | 9/1975 | Brodie | |
| 3,906,671 | A | 9/1975 | Maldonado | |
| 4,070,802 | A | 1/1978 | Odom | |
| 4,166,343 | A | 9/1979 | O'Brian | |
| 4,395,855 | A | 8/1983 | Juker | |
| 4,696,132 | A | 9/1987 | LeBlanc | |
| 4,779,514 | A | 10/1988 | Prigmore et al. | |
| 5,448,799 | A | 9/1995 | Stein, Jr. | |
| 5,493,818 | A | 2/1996 | Wilson | |
| 5,966,956 | A | 10/1999 | Morris et al. | |
| 6,192,909 | B1 | 2/2001 | Strausser | |
| 6,983,567 | B2 | 1/2006 | Ciotti | |
| 8,555,559 | B2 * | 10/2013 | DiGregory | 52/79.5 |
| 2003/0140573 | A1 | 7/2003 | Marcinkowski et al. | |
| 2009/0107020 | A1 | 4/2009 | Aires | |

* cited by examiner

*Primary Examiner* — Basil Katcheves

(57) ABSTRACT

Disclosed is a foldable transportable structure with a three dimensional rectangular shed roof shape having improved component and structural properties, and improved shipping and deployment capabilities. The integrated unique geometric folding pattern means provides enhanced folding accuracy and correct placement of interactive panels during collapse or assembly of the structure, and also greatly increases the flexibility for multiple unit combinations and component materials selection. The folding transportable structure provides a strong, safe, insulated weatherproof structure with a quick setup time, and requires NO tools or separate loose components for assembly.

11 Claims, 13 Drawing Sheets

FOLDABLE TRANSPORTABLE STRUCTURE

CROSS REFERENCE TO RELATED APPLICATIONS

This application is a National Phase filing from International Application serial number PCT/US12/37185 filed Jun. 28, 2012, for a Foldable Transportable Structure of Inventor/Applicant, Vincent J. DiGregory, and a Continuation in Part of U.S. application Ser. No. 13/068,430 filed on May 11, 2011 for a Foldable Transportable Structure of Inventor/Applicant Vincent J. DiGregory.

BACKGROUND OF THE INVENTION

1. Field of the Invention

The present invention relates to a Foldable Transportable Structure that when deployed provides a truly collapsible, transportable, insulated and lightweight structure that is safe reliable and internationally compliant. Its designed flexibility provides maximum convenience for the following: quick deployment to nearly any geographic location; use of varying component materials and sizes; and interconnectability of single units for multiple unit combinations. The ability of the structure to be air-dropped also allows service to the most remote locations where shelter or facility use is needed.

2. Description of the Prior Art

Typically, supplied conventional structures offer only one or a few of a complete set of required properties that include: an easily erectable configuration for fast field installation; a requirement of NO tools or separate parts and pieces for assembly; a capability for remote deployment; a specific insulation value if needed; structural integrity; long-term durability; a design that allows for flexible use of materials choice and the potential to combine together multiple units.

U.S. Pat. No. 5,493,818 describes a "collapsible" structure having improved storage and shipping properties which are achieved by specific designing of the size, shape and hingable connection positions whereas said structure is erectable and collapsible within minutes utilizing a minimal amount of tools and effort.

Geometric and dimensional limitations will not allow this structure to physically collapse into a stackable configuration as claimed. The roof panels will not be able to completely stretch out to lay flat when the roof panels are of a long enough dimension to form a gabled configuration, as their combined length when laying flat is much longer than the available length that the wall panels provide when they are in their folded flat configuration. An attempt to collapse the roof panels into a fully folded flat position will cause the wall panels below to hinge-bind dramatically resulting in neither of the roof or wall panels being able to lay completely flat. Alternately, when the wall panels are in a completely folded flat position the gable roof panels will not be allowed to fully stretch out and lay flat. In summary, the designed geometry will not allow full complete collapse of the stacked panels. All Sections and Claims within U.S. Pat. No. 5,493,818 refer to the invention as being a fully collapsible structure, which it will not be able to accomplish. This may be why it has not been adopted for large scale use.

U.S. Pat. No. 4,779,514 describes a "modular portable building unit" susceptible to air transport, and includes a roof, foldable side walls and foldable end walls having the same width as the height of the side walls. Three of the modular building units can be interfitted (sic) to form a building having four times as much floor space as the single modular building unit. The inclusion of a floor in the modular building is optional, and the inclusion of a separate pitched roof assembly for positive roof drainage is optional. Additional object of the invention is to provide a modular building unit that when folded down will allow transport by air or truck, and to allow combinations of multiple units together.

This method is limited by the gable end panels being separate components, and the separate fastening components and systems required to erect and/or collapse the unit. Redeployment and transport of this structure can be accomplished only after a very time consuming and tedious removal of many parts and pieces has been done. The lack of provisions for a passage opening, door, or other means shown for ingress or egress between the connected units is detrimental to the function and internal occupant flow of the connected units. Therefore no added value to the user from connecting the units together is recognized, and this may be why this system has not been adopted for large scale use.

U.S. Pat. No. 4,166,343 describes a hollow, generally rectilinear structure having a top, a bottom, sides and ends that can be constructed so as to be capable of being manipulated between a "normal" or unfolded type configuration and a collapsed or folded configuration in which the ends extend generally parallel to and beneath the top and in which the sides are folded so as to be located next to the ends generally between the bottom and the top. Such a structure includes hinges connecting the ends to the top so that they can be pivoted so as to lie generally parallel to the top. Such a structure is disclosed as having utility as a playhouse or storage shed but can be utilized for other purposes such as a container.

This structure is limited in that the gable end panels are separate panels that are hinged to the roof panel. The erection of the unit will not be manageable by the roof having to carry the added weight of the gable panels during erection of the side walls and roof panels at the same time. This will be completely unmanageable in the field. The structure also does not have means for combination of multiple units, or optional door placement locations, or a window to provide ventilation. This may be why this structure has not been adopted for field use, and is not a presently being manufactured.

U.S. Pat. No. 3,906,671 describes an adjustable door frame having frame portions formed by first and second frame sections cooperatively arrangeable (sic) on a wall of an opening.

This method provides adjustability only to the door frame for installation to variable wall thicknesses, and can only provide one of four possible door swing functions or configurations when installed. The mitered head jamb and casing pieces directly attach to the mitered hinge and strike jambs. This static configuration does not allow for the potential inversion of the hinge and strike jambs that would be required so that the entire door and frame assembly could be installed in either a right or left hand, or inside or outside, door swing configuration. In order for a door frame assembly to be completely and fully adjustable both of the hinge and strike jamb components must have the ability to be inverted and attachable to either the head or sill components so that the entire frame and door assembly can be installed in any of the 4 each possible swing configurations. This may be why this invention has not been adapted for field structures use.

U.S. Pat. No. 4,395,855 describes a pre-fabricated door frame assembly, the components which are adjustable and such that the assembly can be used for either right or left handed doors and can fit a wide variety of widths and heights of door openings through walls of varying thicknesses.

This method is designed to attach to standard constructed building walls that are normally much wider than the thinner wall panels typically used for flat-pack shelter units, and requires separate fasteners and tools for attachment to the wall system. This invention also does not include an integrated threshold or weather strip component for exterior wall use, which would be necessary for shelter units that would be deployed in hot or cold climates. This invention has limited use in that is does not offer diversity and the flexibility to be used in both interior and/or exterior applications, and it is not easily reversible or re-installable in the field without the use of tools or separate fasteners that may or may not be available.

U.S. Pat. No. 3,420,003 describes an adjustable door frame that adjusts to varying wall thicknesses, and can be installed quickly and easily with screws that go directly into the wall system. It consists of several longitudinal trim and jamb components that overlap and stay in place by ratchet teeth and backing plates that when the installation screw component is installed the separate pieces become locked into place.

This method is designed to attach to standard constructed building walls, and requires separate fasteners and tools for attachment to the wall system. This invention also does not include an integrated threshold or weather strip component for exterior wall use, which would be necessary for shelter units that would be deployed in hot or cold climates. This invention has limited use in that is does not offer diversity and the flexibility to be used in both interior and/or exterior applications, and it is not easily reversible or re-installable in the field without the use of tools or separate fasteners that may or may not be available.

U.S. Pat. No. 5,448,799 describes a hinge assembly for pivotally adjoining two panels together such as a shower door and its enclosure. A pair of continuous channel members are provided which are provided with an axial aligned rod and tubular channel for rotatably (sic) receiving the rod.

This method includes a weather strip component that protrudes beyond the profile of the wall panel extrusions. This component could not be utilized in a foldable structure as the protrusion will not allow adjacent and connected together wall panels to lay flat against each other when the structure, is in a collapsed position.

SUMMARY OF THE INVENTION

The present invention is a Folding Transportable Shelter with improved properties of: accurate folding hinge geometry, advanced interactive and integrated components that are designed to allow for either transportable or assembled structure configuration; advanced component materials for increased insulation; structural integrity; long-term dependability; built-in flexibility for optional placements of doors, windows or clear openings; and built-in flexibility for choice and use of varying materials and sizes for integrated components.

It is therefore a primary objective of the present invention to provide a foldable transportable structure that will significantly enhance the quality, functionality, stackable transportability, flexibility and affordability of moveable shelter structures.

It is another object of the present invention to include in the design a sophisticated geometric folding pattern means that significantly improves the allowance for integration and use of varying component materials, and also significantly improves the interactive complimentary relationships of folding accuracy, necessary clearances, and continual structural contact between adjacent components during the collapse and assembly functions of the unit.

It is another object of the present invention to include in the design same said sophisticated geometric folding pattern means that remains static, while allowing complete flexibility for: choice of overall structure size; use of any chosen dimension for panel thicknesses and relative connector widths; ability to combine together floor, wall and roof panels that are comprised of different individual thicknesses to obtain varying insulation values; without any of the above impacting the folding and assembly accuracy, or overall capabilities of the structure.

It is a further object of the present invention to provide specific designed continuous pivot hinge-to-panel connectors, an adjustable door assembly, a leveling foot assembly, a strap conveyance and tie-down assembly, and a flexible fillable bladder bag component to further improve the function, flexibility and use of the structure.

It is a further object of the present invention to provide a foldable transportable structure that has flexible integral components that are interchangeable during the manufacturing process for making structures that provide specific solutions for use in variable field conditions that include climatic, structural, deployment and usage considerations.

It is still another object of the present invention to provide a foldable transportable structure that contains the flexibility to be interconnected with additional like units of varying wall thicknesses to make larger structures, and includes removable wall panel sections for in-the-field-flexibility to interchange doors, windows or clear openings to create various configurations for maximum internal occupant flow and use.

These, and other objects of the present invention, will become apparent to those skilled in the art upon reading the accompanying description, drawings, and claims set forth herein.

DETAILED DESCRIPTION OF THE INVENTION

Figure 1:
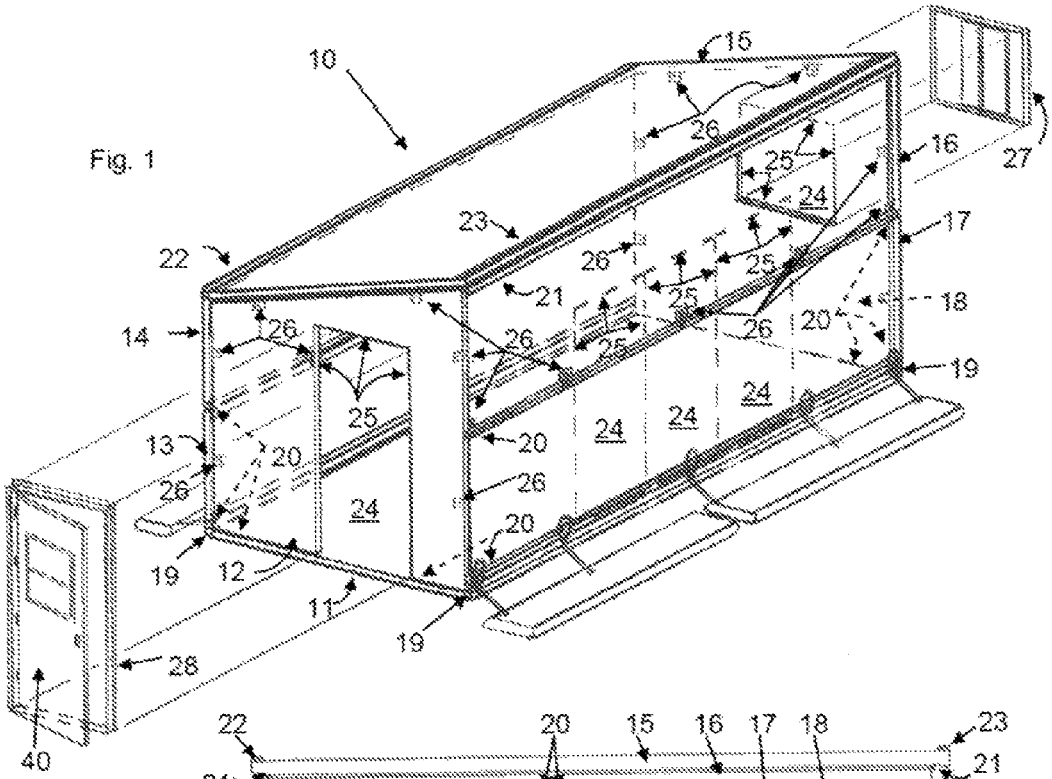
FIG. 1 is a perspective view of the erected Foldable Transportable Structure according to the present invention.
Figure 19:
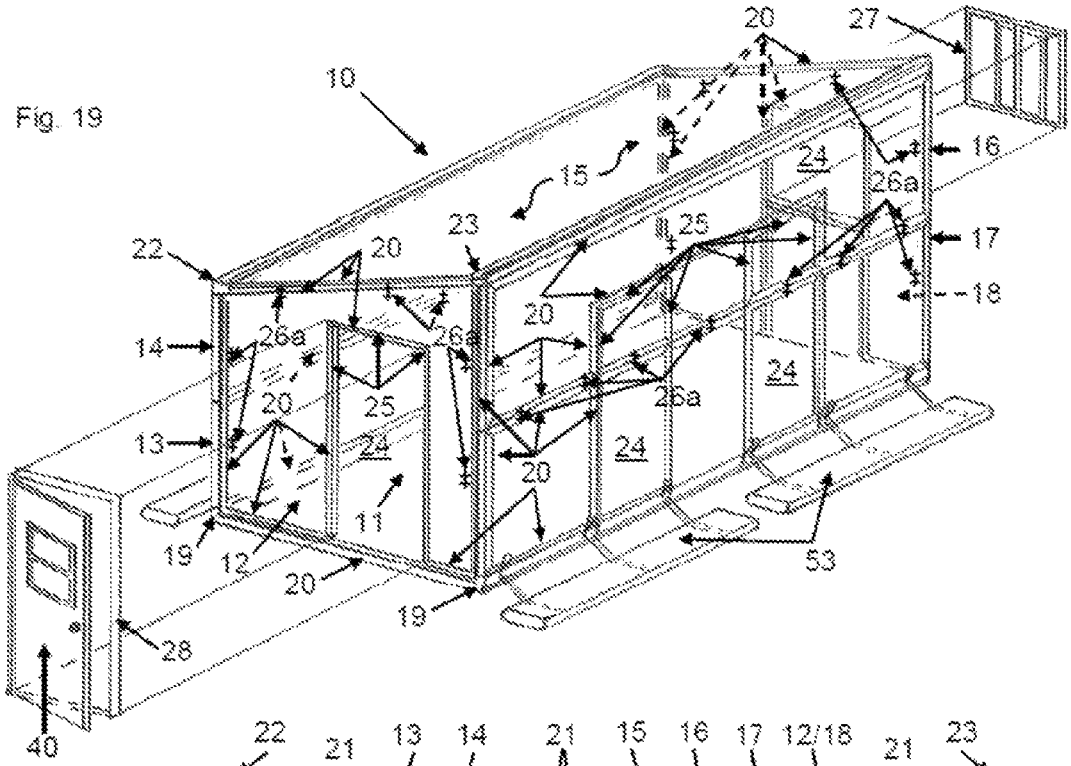
FIG. 19 is a perspective view of the erected Foldable Transportable Structure containing alternate embodiments according to the present invention.

FIG. 1, and FIG. 19 containing alternate embodiments, shows a perspective view of the best mode contemplated by the inventor of the erected Foldable Transportable Structure 10 according to the concepts of the present invention. As seen by the drawings the foldable transportable structure 10 consist of a series of structural panels and continuous pivot hinge components connected together in a way that allows for either a folding up of the structure into a fully erected configuration as seen in FIG. 1 and FIG. 19, or a folding down of the structure into a flat fully collapsed configuration for transportable methods as seen in FIG. 2, FIG. 20, FIG. 17 and FIG. 35.

Figure 4:
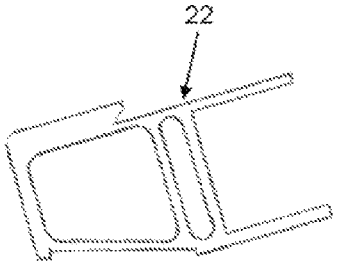
FIG. 4 is a sectional view of the Roof Eave connector component according to the present invention.
Figure 5:
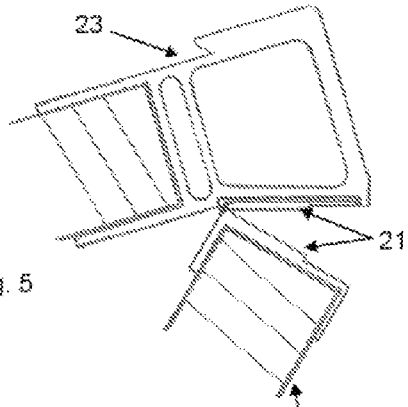
FIG. 5 is a sectional view of the roof to wall connected components according to the present invention.
Figure 8:
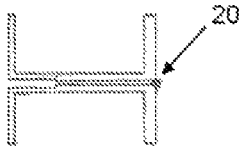
FIG. 8 is a sectional view of the Wall-to-Wall connector component according to the present invention.
Figure 9:
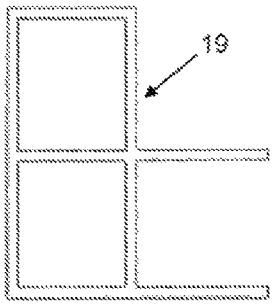
FIG. 9 is a sectional view of the Floor Curb connector component according to the present invention.
Figure 10:
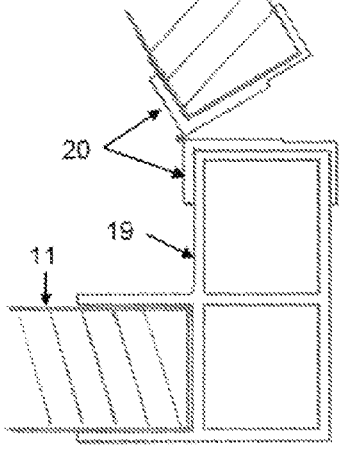
FIG. 10 is a sectional view of the wall to floor connected components according to the present invention.
Figure 11:
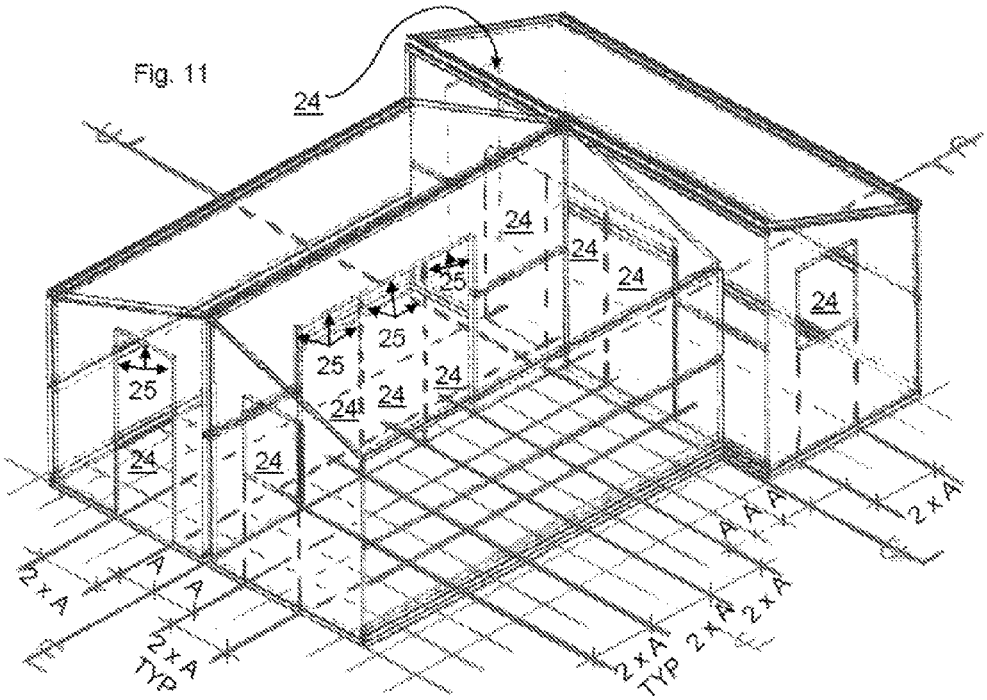
FIG. 11 is a perspective view showing the Horizontal Grid and Dimension Pattern according to the present invention.
Figure 12:
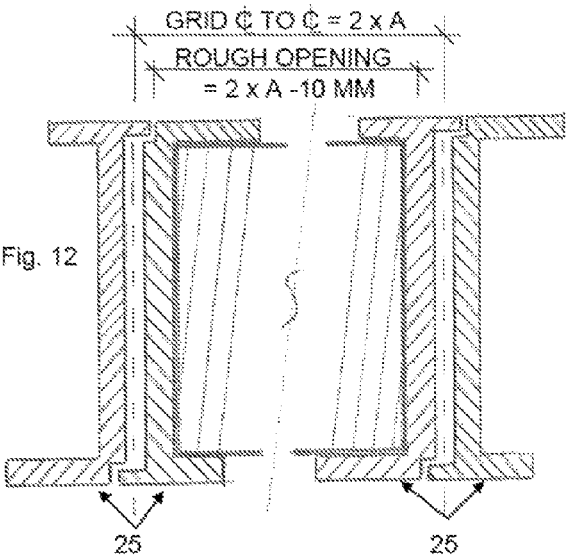
FIG. 12 is a sectional view of the Removable Wall Panel trim components according to the present invention.
Figure 13:
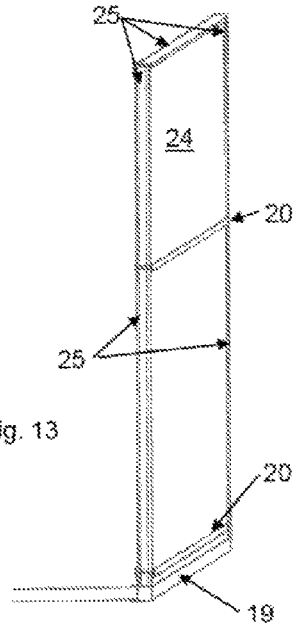
FIG. 13 is a perspective view showing the Removable Wall Panel assembly according to the present invention.
Figure 17:
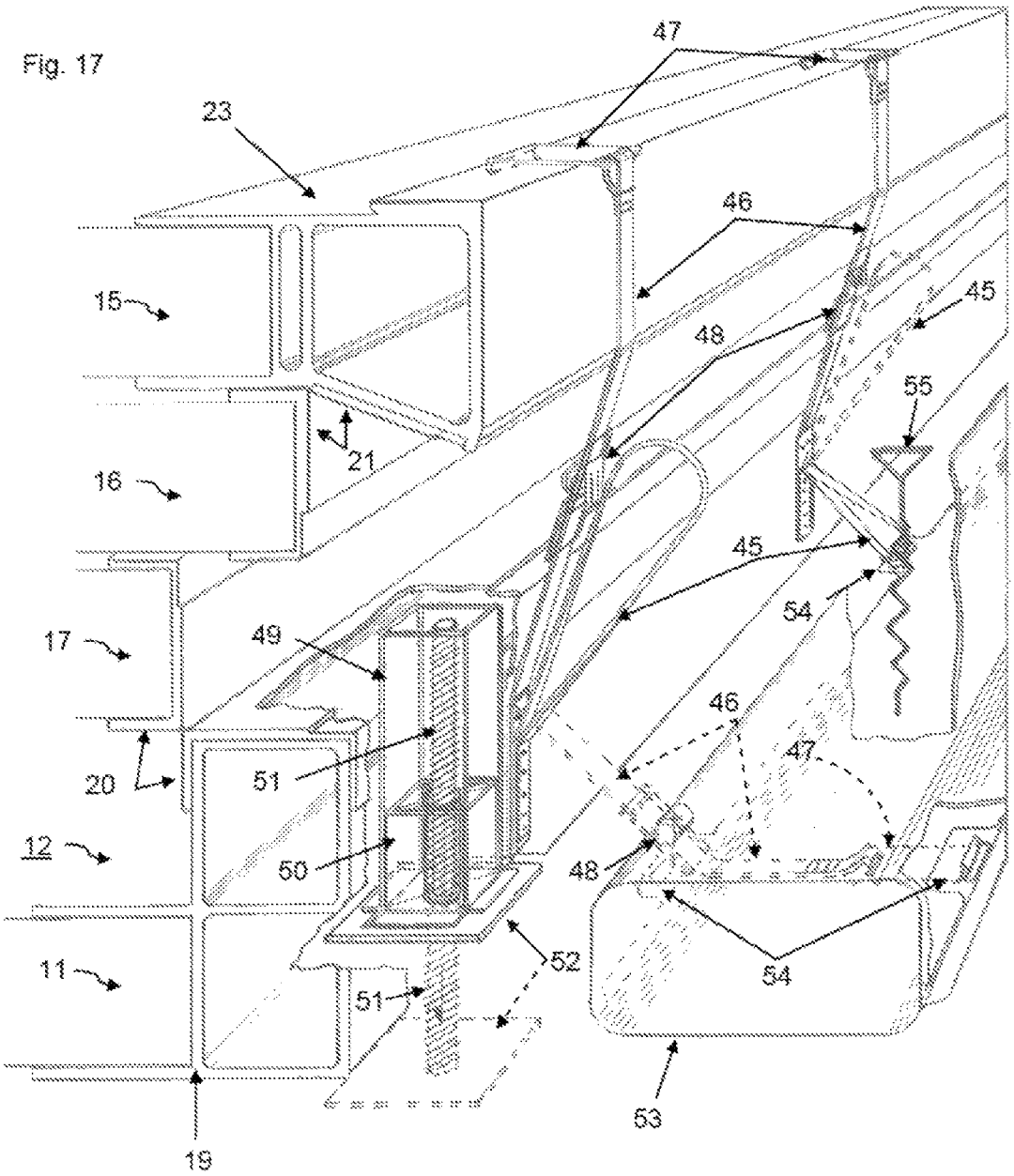
FIG. 17 is a perspective cut-away view of the collapsed Foldable Transportable Structure according to the present invention.
Figure 22:
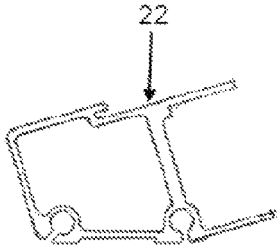
FIG. 22 is a sectional view of the alternate embodiment Roof Eave connect component according to the present invention.
Figure 26:
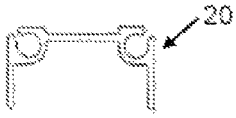
FIG. 26 is a sectional view of the alternate embodiment Wall Hinge connector component according to the present invention.
Figure 27:
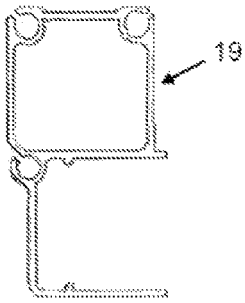
FIG. 27 is a sectional view of the alternate embodiment Floor Curb connector component according to the present invention.
Figure 23:
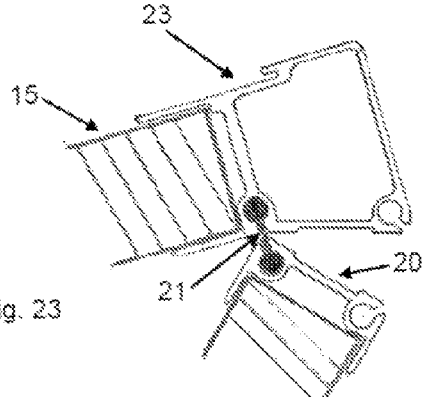
FIG. 23 is a sectional view of the roof to wall connected components containing alternate embodiments according to the present invention.
Figure 28:
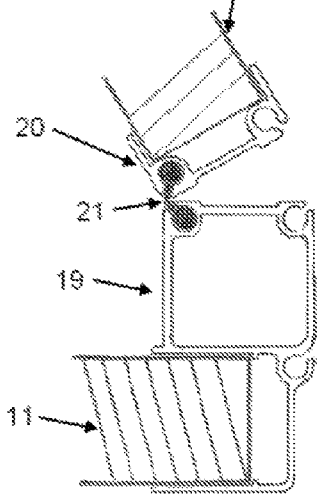
FIG. 28 is a sectional view of the wall to floor connected components containing alternate embodiments according to the present invention.
Figure 29:
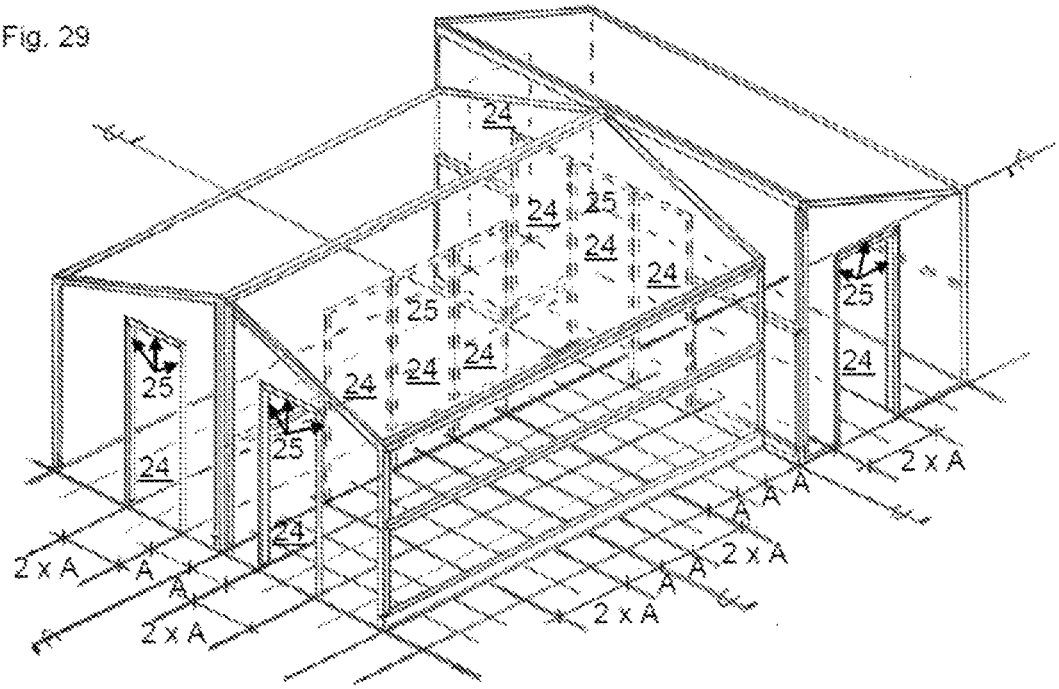
FIG. 29 is a perspective view showing the Horizontal Grid and Dimension Pattern containing alternate embodiments according to the present invention.
Figure 30:
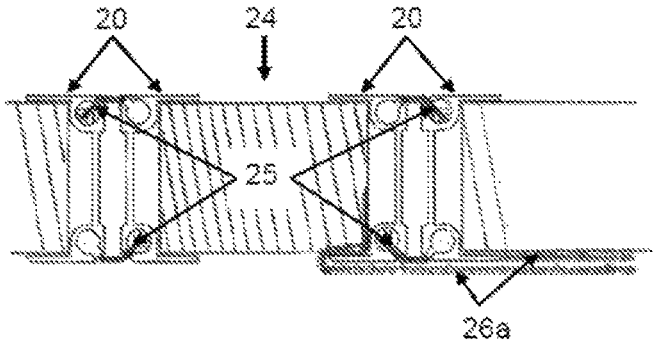
FIG. 30 is a sectional view of the alternate embodiment Removable Wall Panel components according to the present invention.
Figure 31:
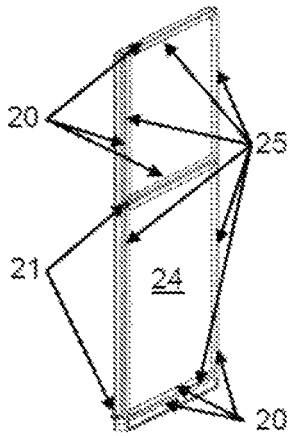
FIG. 31 is a perspective view showing the Removable Wall Panel assembly containing alternate embodiments according to the present invention.
Figure 35:
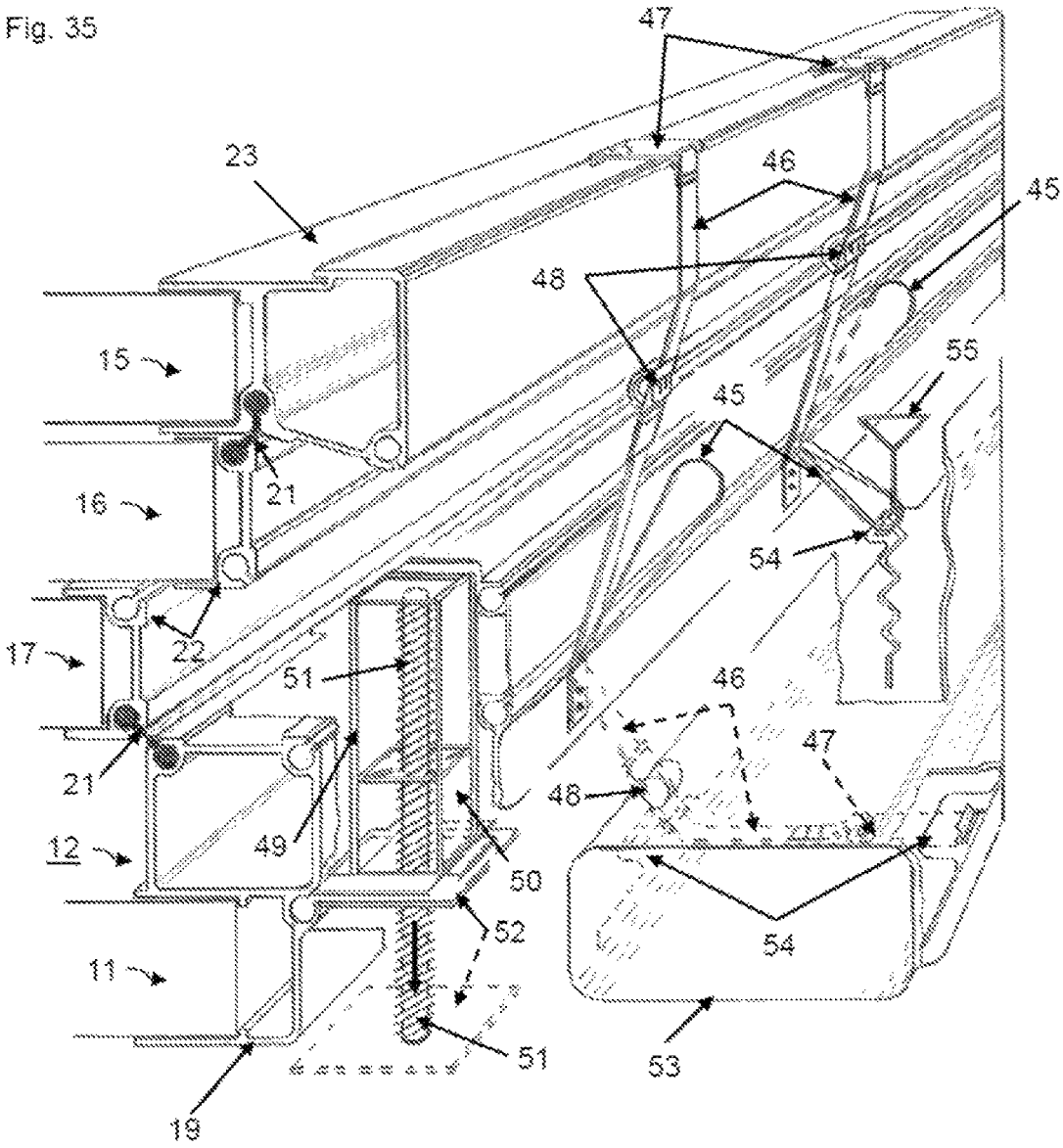
FIG. 35 is a perspective cut-away view of the collapsed Foldable Transportable Structure containing alternate embodiments according to the present invention.

In general the foldable transportable structure 10 connector and hinging components can be attached together with load compliant structural adhesives, tapes or fasteners of any type. As seen in FIG. 1 and FIG. 19 the foldable transportable structure 10 consists of a single floor panel 11 of which each of its long axis exposed edges are connected to a Floor Curb component 19 as seen in FIG. 9, FIG. 10 and FIG. 17, or alternate embodiment Floor Curb component 19 as seen in FIG. 27, FIG. 28 and FIG. 35. One half of a Wall-to-Wall hinge component 20 as seer in FIG. 8, or alternate embodiment Wall Hinge component 20 as seen in FIG. 26 is connected to the remaining short axis exposed edges of the floor panel 11 as seen in FIG. 1 and FIG. 19 to complete the floor panel assembly. A continuous Wall Hinge component 20 as seen in FIG. 8 and FIG. 26 is connected to each of the four exposed edges located on both of the short side wall panels 13 and 14, and also to each of the four exposed edges located on both of the tall side wall panels 16 and 17, as seen in FIG. 1 and FIG. 19, FIG. 5 and FIG. 23, FIG. 7 and FIG. 25, and FIG. 10 and FIG. 28 to complete the short and tall side wall panel assemblies. One half of a Wall-to-Wall hinge component 20 as seen in FIG. 8, or alternate embodiment Wall Hinge 20 seen in FIG. 26 is connected to each of the eight exposed edges of both of the gable wall panels 12 and 18 as seen in FIG. 1 and FIG. 19 to complete the gable wall panel assemblies. A Roof Eave component 22 as seen in FIG. 4, or alternate embodiment Roof Eave component 22 as seen in FIG. 22, is connected to one each long axis exposed edge of the roof panel 15 as seen in FIG. 1 and FIG. 19. The remaining long axis exposed edge of the roof panel 15 is connected to Roof Ridge component 23 as seen in FIG. 1, FIG. 5 and FIG. 17, or alternate embodiment Roof Ridge component 23 as seen in FIG. 19, FIG. 23 and FIG. 35. One half of Wall-to-Wall hinge component 20 as seen in FIG. 8, or alternate embodiment Wall Hinge component 20 as seen in FIG. 26 is connected to both of the remaining short axis exposed edges of the roof panel 15 as seen in FIG. 1 and FIG. 19 to complete the roof panel assembly. An interlocking removable panel trim component 25 as seen in FIG. 12 is connected to each of the eight exposed edges of the removable wall panels 24 as seen in FIG. 1, FIG. 11 and FIG. 13, or alternate embodiment Wall Hinge component 20 as seen in FIG. 30 is connected to each of the eight exposed edges of the removable wall panels 24 as seen in FIG. 19, FIG. 29 and FIG. 31 to complete the removable wall panel assemblies.

Figure 24:
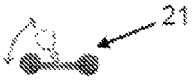
FIG. 24 is a sectional view of the alternate embodiment continuous flexible Dumbbell Hinge connector component according to the present invention.

Each long axis of the floor 11, short walls 13 and 14, tall walls 16 and 17 and roof panel 15 assemblies as seen in FIG. 1 and FIG. 19 are connected together by the integral flexible hinge portion on components 20 or 21 as seen in FIG. 5, FIG. 6, FIG. 7, FIG. 8, FIG. 10 and FIG. 17, or with the alternate embodiment Dumbbell Hinge component 21 as seen in FIG. 24 that slides into the respective hinge slots located on each of the Floor Curbs 19, Wall Hinges 20, Roof Eave 22 and Roof Ridge 23 components as seen in FIG. 23, FIG. 25, FIG. 28 and FIG. 35. The Wall Hinge components 20 located at the bottom of the Gable wall panels 12 and 18 as seen in FIG. 1 and FIG. 19 are attached to the adjacent Wall Hinge component 20 located on the short axis of the floor panel 11 by a continuous Dumbbell Hinge component 21 as seen in FIG. 24, thus completing the entire structure's connected panel assembly.

Figure 18:
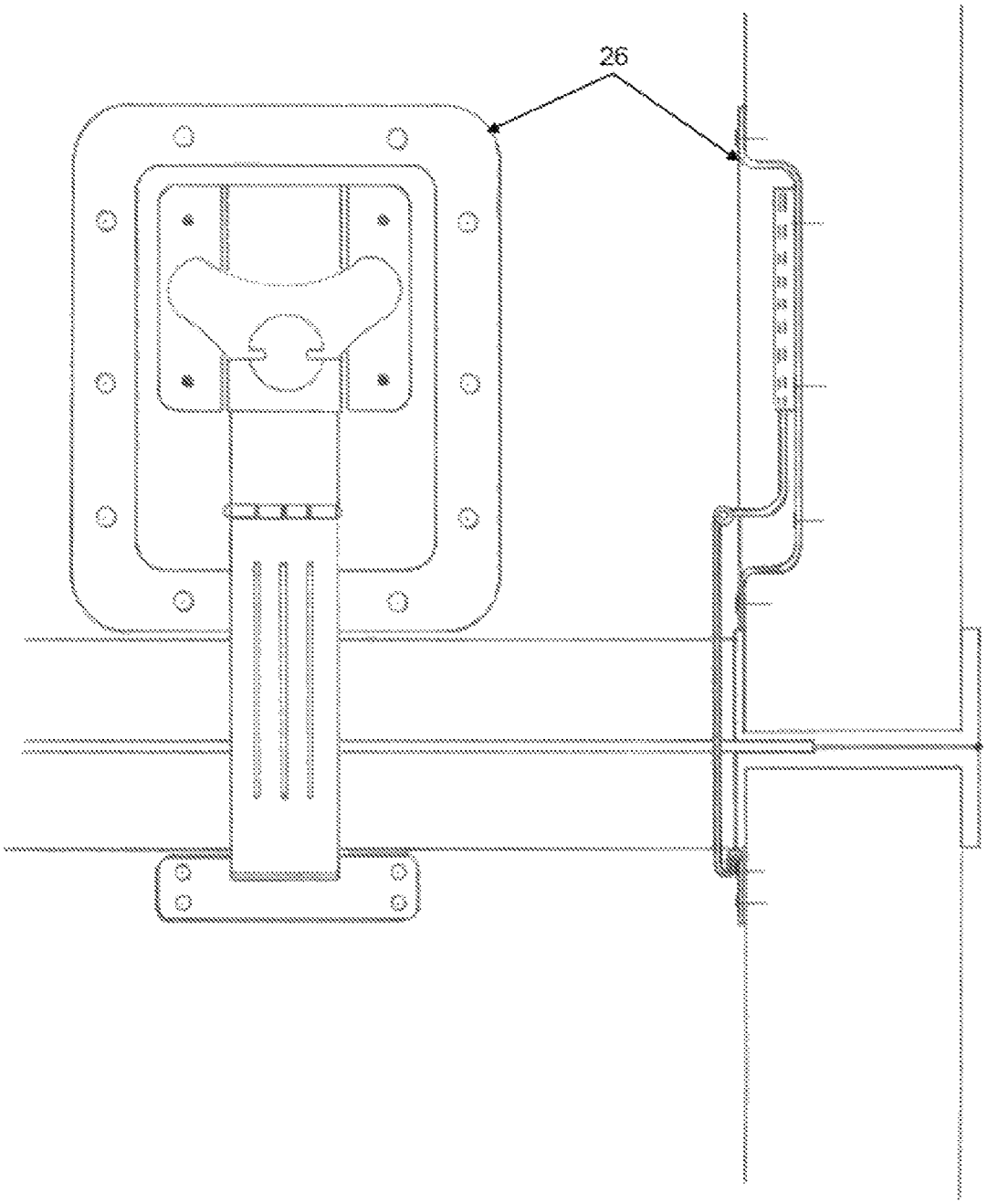
FIG. 18 is an elevation and section view of the Draw Latch component according to the present invention.
Figure 36:
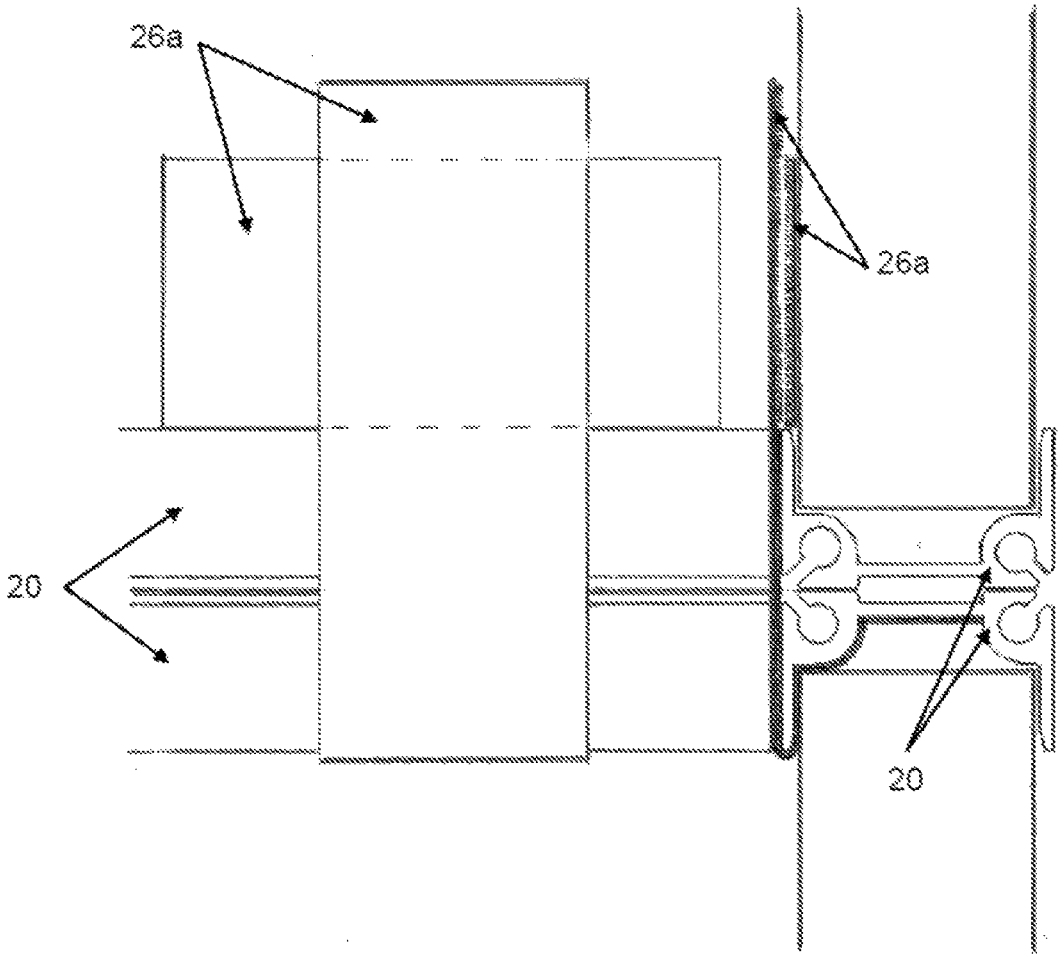
FIG. 36 is an elevation and section view of the alternate embodiment Reclosable Latch component according to the present invention.

When the structure 10 is in its fully erected configuration as seen in FIG. 1 and FIG. 19 each individual wall panel is secured to its adjacent panel by a series of either structural draw latches 26 as seen in FIG. 18, or alternate embodiment reclosable locking (Velcro™ type) straps 26*a* as seen in FIG. 36. These structural latches are also located around the perimeter of a removable panel 24 as seen in FIG. 30 and must be disengaged in order to allow each individual wall panel to be folded down, or an individual removable panel to be removed or relocated within the structure.

Figure 2:
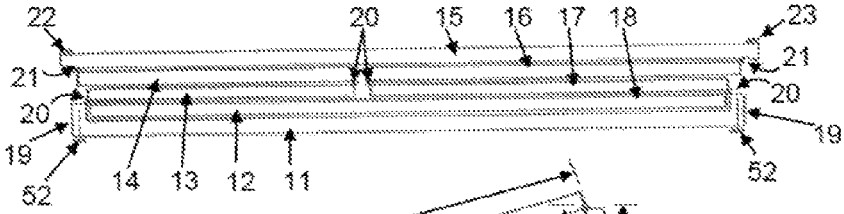
FIG. 2 is a sectional view of the collapsed Foldable Transportable Structure according to the present invention.
Figure 20:
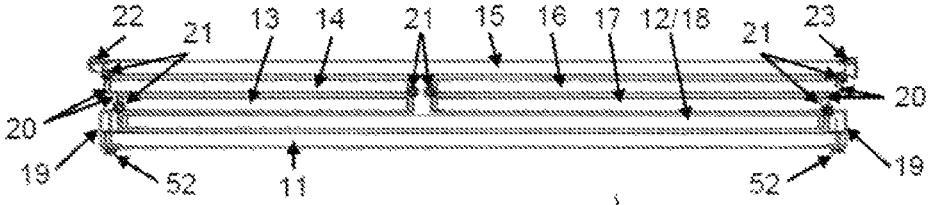
FIG. 20 is a sectional view of the collapsed Foldable Transportable Structure containing alternate embodiments according to the present invention.

FIG. 2, and FIG. 20 containing alternate embodiments, shows a cross section of the collapsed structure in its folded flat transportable configuration. For further reference FIG. 17, and FIG. 35 containing alternate embodiments, show a more detailed view of the individual panels when they are arranged in the folded flat configuration. To collapse the structure the following procedure is followed: gable end wall panels 12 and 18 are folded inward to lay flat on top of the single floor panel 11; the short side walls 13 and 14 are folded inward to lay flat on top of the gable wall panels 12 and 18; the tall side walls 16 and 17 are folded inward to lay flat on top of the gable wall panels 12 and 18; the single roof panel 15 follows the folding path of each side wall 14 and 16, as each are folded down into their relative position, to then lay flat on top of walls 14 and 16. To secure the panels together in the folded flat configuration for transportation a series of adjustable strap tie-down assemblies made up of components 45, 46, 47 and 48 are hooked onto the Roof Eave component 22 and Roof Ridge component 23 as seen in FIG. 17 and FIG. 35. To erect the structure simply reverse the process as described above.

Figure 3:
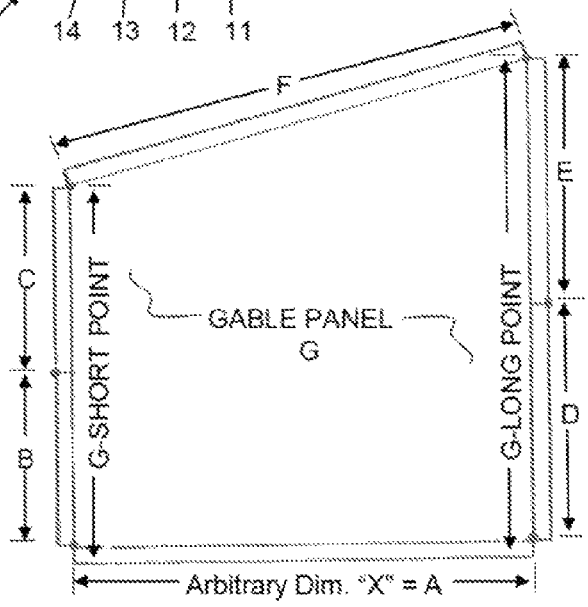
FIG. 3 is a sectional view of the Geometric Folding Pattern included in the Foldable Transportable Structure according to the present invention.
Figure 21:
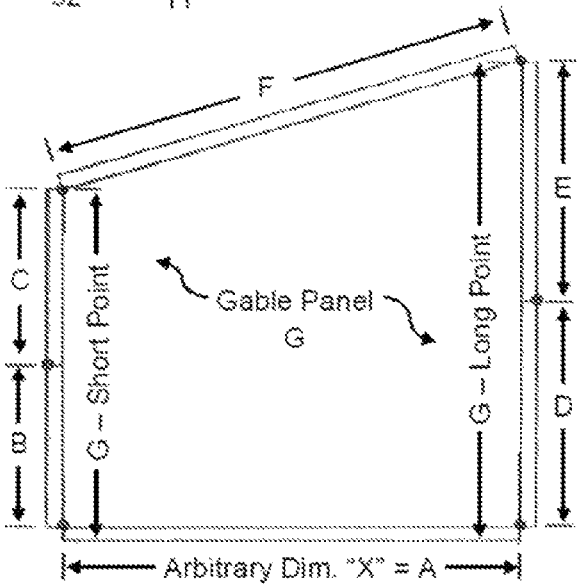
FIG. 21 is a sectional view of the Geometric Folding Pattern containing alternate embodiments included in the Foldable Transportable Structure according to the present invention.

FIG. 3, and FIG. 21 containing alternate embodiments, shows the vertical layout for the Geometric Folding Pattern that formulates the static hinge-to-hinge pivot point centering relationship between the structure's adjacent individual panels, and establishes a guide to determine the finished panel widths or height dimensions for the floor panel 11, the wall panels 13, 14, 16 and 17, the roof panel 15, the gable wall panels 12 and 18, and the vertical short and long points for the gable wall panels 12 and 18. The relative dimensions are defined using the following static pattern formulation: a floor panel expressed as 'A' with an arbitrarily chosen width dimension being designated as 'X'; a bottom short wall panel expressed as 'B' being of a height that is relative to 41.27617% of 'X'; an upper short wall panel expressed as 'C' being of a height that is relative to 43.27018% of 'X'; a bottom tall wall panel expressed as 'D' being of a height that is relative to 55.63310% of 'X'; an upper tall wall panel expressed as 'E' being of a height that is relative to 57.76271% of 'X'; a roof panel expressed as 'F' that is of a width that is relative to 103.98803% of 'X'; a pair of gable panels expressed as 'G' that are of a width that is relative to 99.70089% of 'X'; a pair of gable panels expressed as 'G' with a short point height that is of a length that is relative to 84.24725% of 'X' plus the chosen thickness width of the wall panels; a pair of gable panels expressed as 'G' with a long point height that is of a length that is relative to 112.96111% of 'X' plus the chosen thickness width of the wall panels.

Figure 6:
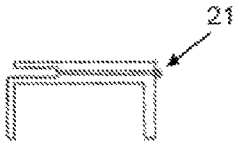
FIG. 6 is a sectional view of the Roof-to-Wall connector component according to the present invention.

FIG. 4 shows a detail cross sectional view of the Roof Eave connector component 22. Roof Eave 22 is permanently attached to one long axis edge of the roof panel 15 as seen in FIG. 1 and FIG. 2, and similar to FIG. 5. Roof Eave 22 is always attached to the short wall upper panel assembly 14 with Wall-to-Roof connector component 21 as seen in FIG. 6 to create the low side of the roof slope for the fully erected structure 10 as can be seen in FIG. 1. See alternate embodiment for Roof Eave connector component 22 in FIG. 22.

FIG. 5 shows a detail cross sectional view of the Roof Ridge to upper wall assembly, and the related hinging motion according to the present invention. The Roof Ridge connector component 23 is permanently attached to the roof panel 15 and connected to the adjacent wall 16 by Wall-to-Roof connector component 21 as seen in FIG. 6. This hinged connection allows the adjacent attached panels to fold up into a fully erected structure configuration or fold down into a flat collapsed configuration. Roof Ridge 23 is always hinged to the tali wall upper panel assembly 16 to create the high side of the roof slope for the fully erected structure 10 as can be seen in FIG. 1. See alternate embodiment for roof ridge to wall assembly in FIG. 23.

FIG. 6 shows the Wall-to-Roof flexible hinge component 21 that is used to connect the short wall upper panel 14 as seen in FIG. 1 to the bottom of the Roof Eave connector component 22 as seen in FIG. 1 and FIG. 4, or the tall wall upper panel 16 to the Roof Ridge connector component 23 as seen in FIG. 1 and FIG. 5, and provides the hinging ability to fold the structure up or down. See alternate embodiment for hinge component 21 in FIG. 24.

Figure 7:
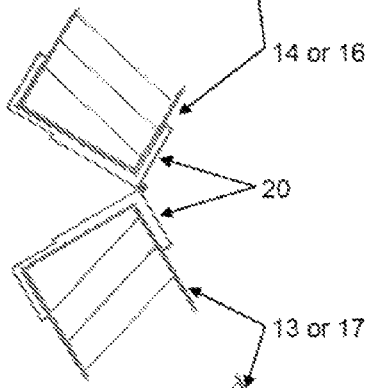
FIG. 7 is a sectional view of the mid wall to wall connected components according to the present invention.

FIG. 7 shows a detail cross sectional view of the wall to wall middle hinged connection of an upper tall wall panel assembly 16 to a lower tall wall panel assembly 17, and the related hinging motion according to the present invention. The Wall-to-Wall connector component 20 as seen in FIG. 8 is permanently attached to tall wall panels 16 and 17, or to short wall panels 13 and 14 located on the opposite side of the structure as seen in FIG. 1. The hinged connection allows the adjacent attached panels to fold up into a fully erected structure configuration or fold down into a flat collapsed configuration. See alternate embodiment for wall to wall assembly in FIG. 25.

FIG. 8 shows a detail cross sectional view of the Wall-to-Wall connector component 20. Wall-to-Wall connector component 20 as seen in FIG. 1, FIG. 2 and FIG. 17 is a permanently attached to a panel edge or Floor Curb 19 components where hinges locations are required as seen in FIG. 2, FIG. 7, FIG. 10, FIG. 13 and FIG. 17. Wall-to-Wall connector component 20 is split in half at the hinge point to then be used as a trim component for attachment to the remaining panel edges that are exposed and do not require a hinge function. See alternate embodiment for Wall Hinge connector component 20 in FIG. 26.

FIG. 9 shows a detail cross sectional view of the Floor Curb connector component 19. Floor Curb 19 is permanently attached to each long axis edge of the floor panel 11 as seen in FIG. 1, FIG. 2 and FIG. 10. The top half of Floor Curb connector component 19 is removed where removable panels 24 are located to create an opening flush to the floor panel 11. See alternate component for Floor Curb connector component 19 in FIG. 27.

FIG. 10 shows a detail cross sectional view of the Floor Curb to the lower wall assembly, and the related hinging motion according to the present invention. The Floor Curb connector component 19 is permanently attached to the floor panel 11 and connected to the adjacent wall 17 by the Wall-to-Wall connector component 20 as seen in FIG. 8. This hinged connection allows the adjacent attached panels to fold up into a fully erected structure configuration or fold down into a flat collapsed configuration. See alternate embodiment for floor to wall assembly in FIG. 28.

FIG. 11 shows a perspective view showing the architectural Horizontal Grid Pattern that establishes the structure's basic dimension design, and also facilitates specific aligned layout locations for removable wall panels, door and window assemblies for interchangeability between complexed units according to the present invention. Removable wall panel 24 locations allow the creation of clear openings or window 27 and door 28 installations as seen in FIG. 1 in any one of variable locations within the tall or gable walls of the structure. The finished dimension width of the removable wall panel 24 and its respective rough opening is a result of two (2) times an Arbitrary Dimension expressed as 'A'. See alternate embodiment for horizontal grid pattern in FIG. 29.

FIG. 12 shows a detail cross sectional view of the Removable Wall Panel 24 assembly and components. A Wall-to-Wall connector component 20 is permanently attached between the upper and lower panel sections to provide the required hinging action. An interlocking panel edge trim 25 as seen in FIG. 12 and FIG. 13 is permanently attached to each of the remaining removable wall panel edges. A series of draw latches 26 as seen in FIG. 18 are attached to the panels to secure the removable wall panel 24 assembly to the adjacent panel assemblies. See alternate embodiment for removable panel assembly 24 in FIG. 30.

FIG. 13 shows a perspective elevation of the assembled removable wall panel 24, and the locations of relative components. See alternate embodiment for removable panel assembly 24 in FIG. 31.

Figure 14:
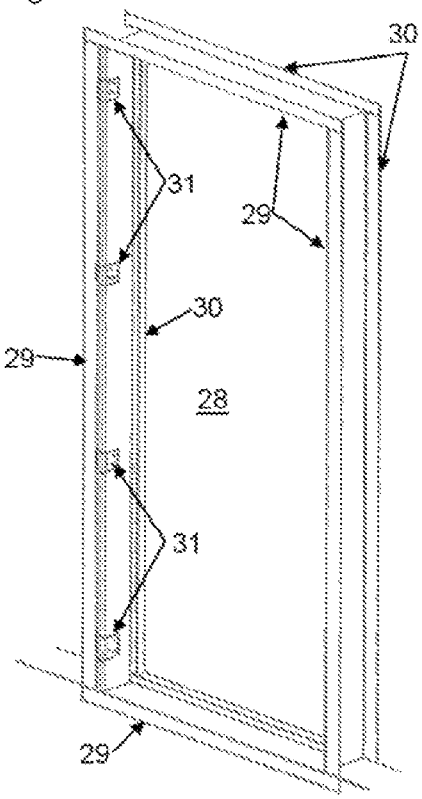
FIG. 14 is a perspective view of the FlexFrame Door assembly according to the present invention.
Figure 15:
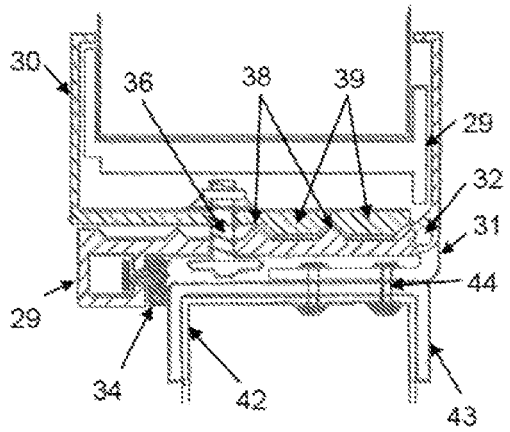
FIG. 15 is a sectional view of the FlexFrame Door jamb components according to the present invention.
Figure 16:
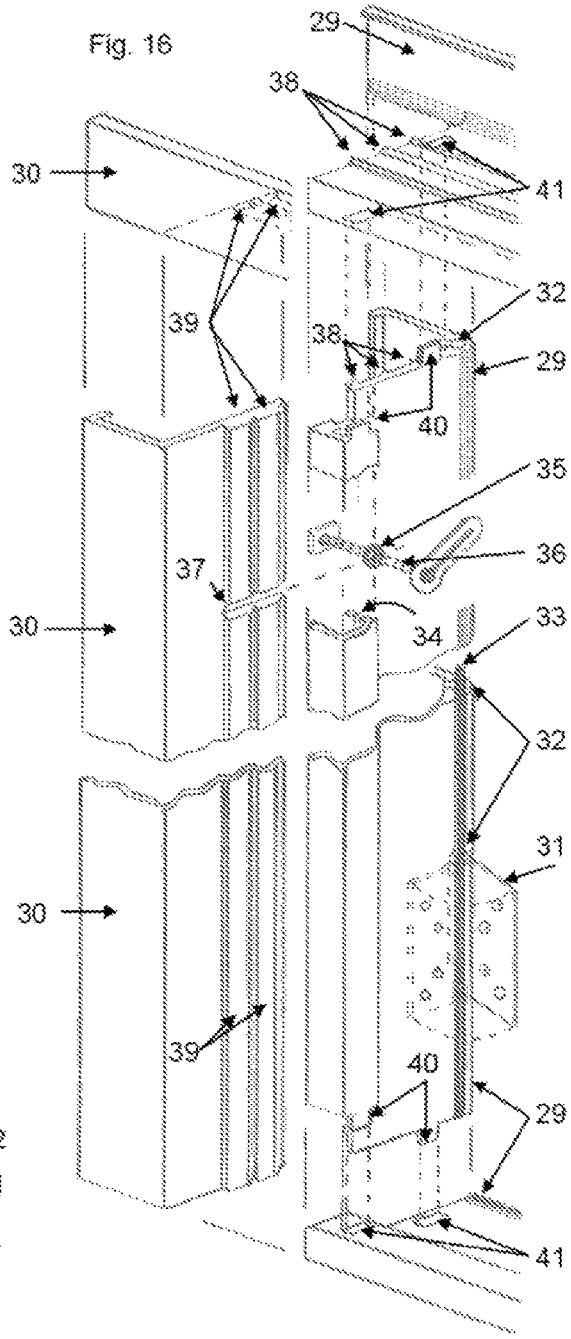
FIG. 16 is an exploded perspective elevation view of the FlexFrame Door components according to the present invention.

FIG. 14 shows a perspective elevation view of the overall configured door frame assembly 28 as seen in FIG. 1 which includes a series of separate adjustable interlocking jamb components 29 and 30, and a series of hinge components 31 as seen in FIG. 15 and FIG. 16. See alternate embodiment for door frame assembly 28 in FIG. 32.

FIG. 15 shows a detail cross section of the jamb components to include the following: a jamb component 29, with a series of 'V' shaped protrusions 38 running the length of the component, that is used for the side jambs, header and sill components; an interlocking jamb component 30, with a series of 'V' shaped grooves 39 running the length of the component that mate with the 'V' shaped protrusions 38 of jamb component 29, to allow overall jamb width adjustability to varying wall thickness widths; a series of thumb-turn threaded rod with compression nut locking assemblies 36 for securing jamb components 29 and 30 together; and a hinge component 31 for attachment of the door 42 and door panel trim 43 to the side jamb component 29. See alternate embodiments for door components in FIG. 33.

Figure 33:
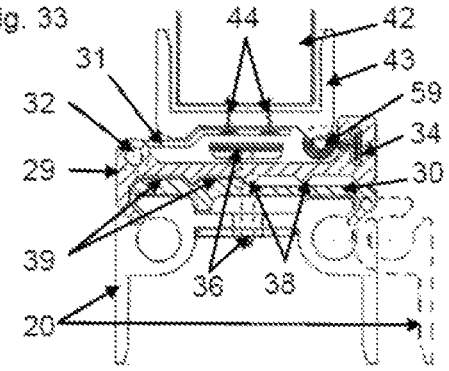
FIG. 33 is a sectional view of the alternate embodiment FlexFrame Door jamb components according to the present invention.

FIG. 16 shows a perspective cut-away elevation of the various door frame components to illustrate more specifically individual component relationships, details, and the reversible and invertible function of the door assembly. Jamb component 29 and separate hinge components 31 each include a round hollow profile 32, as can be more aptly seen in FIG. 15, on their respective outside edges that allow insertion of a continuous hinge securing rod 33 to attach the two components together. The single hinge-side jamb component 29 includes a series of cut-out sections to allow insertion of hinge components 31 and corresponding vertical alignment of their respective round hollow profiles 32. Side jamb, header and sill components 29 each include an extruded open slot to receive a continuous weatherstrip component 34, as can be more aptly seen in FIG. 15. Jamb components 29 include a series of holes 35 where a thumb-turn threaded rod with compression nut locking assembly 36 is installed. Corresponding jamb components 30 include a series of open-ended slots 37 that align with the series of thru-bolts 36 installed on jamb components 29. Together components 36 and 37 allow for a sliding back and forth motion between jamb components 29 and 30 for adjustability to variable adjacent wall panel thicknesses. Jamb components 29 include a series of protruding 'V' shapes 38 that rest into a corresponding series of reverse retention 'V' shapes 39 that are integral to jamb components 30. Jamb components 29 and 30 are then prevented from sliding apart when tightened together with the thumb turn threaded rod with compression nut assembly 36. The two each side jamb components 29 each include on their ends a pair of male tabs 40 that fit into a corresponding pair of female slots 41 that are punched into the top surfaces of the header and sill components 29. The series of tabs 40 and slots 41 prevent potential horizontal movement between the two each side jamb components 29 and the header and sill components 29. The series of tabs 40 and slots 41 also allow the hinge-side jamb component 29 and attached door components 42 and 43 to be inverted between the header and sill components 29 in order to change the door to either a right or left handed swing function. The entire door assembly 28 is also installable on either the exterior or interior of the wall to additionally provide for any of the four each possible swing functions required. A structural insulated door panel 42 as seen in FIG. 15 and FIG. 33 is wrapped on all four side edges with a 'U' shaped trim cap component 43, and is attached with a series of fasteners 44 to a series of symmetrically centered surface mounted hinge components 31. A commercially available flush mounted latching and locking mechanism is installed in the door panel component 42 to complete the door assembly. Each of the door assembly components can be made from any variety or combination of metals, plastics, composites, fiber reinforced polymers, fiberglass or other types of material. See alternate embodiments for door components in FIG. 33 and FIG. 34.

FIG. 17 shows a perspective cut-away view of the collapsed structure showing the adjustable strap conveyance and tie-down assembly, the adjustable leveling foot assembly, the spiral ground stake component, the fillable bladder bag component, and the relationship between components according to the present invention. A series of load compliant looped strap carrying handles 45 are attached to the floor curb component 19 for conveyance of the transportable structure 10. Two separate continuing sections of the tie-down strap 46 are interconnected with a commercially available load compliant ratchet-tight buckle 48. The remaining end of the tie-down strap 46 is attached to a commercially available load compliant flat hook 47. Hook 47 connects to the Roof Eave component 22, or Roof Ridge component 23 for securing the structure 10 while it is in a flat collapsed transportable configuration, or alternately hooks onto either the eyelet 54 that is integral to bladder bag 53, or onto a spiral ground stake 55, for securing the fully erected structure 10 to the ground. The bladder bag 53 is filled with water, or is covered with earth, sand, gravel, or other material to add hold-down ballast weight to the fully erected structure 10. A series of adjustable leveling pad assemblies are installed inside of the Floor Curb connector component 19. A load compliant square tube 49 is securely installed in component 19. A load compliant leveling tube adapter 50 is inserted into component 49. A load compliant fast-turn threaded rod 51 of sufficient length is welded to a load compliant leveling foot 52, and is then inserted into the receiving threads of the leveling tube adapter 50. When the structure 10 is in its collapsed transportable configuration the leveling foot pad 52 is in a completely retracted position and alternately provides stacking guidance and transportation containment by sliding into and resting on the top track and curb of a lower structure's roof components 22 and 23. See alternate embodiments for the structure in FIG. 35.

FIG. 18 shows a section and elevation view of the structural load compliant valance draw latch 26 as can be seen in FIG. 1 that is connected to the various adjacent panel assemblies to secure the panels from unhinging or being removed while the structure is in a fully erected configuration. See alternate embodiment latch in FIG. 36.

FIG. 19, containing alternate embodiments to FIG. 1, shows a perspective elevation of the best mode contemplated by the Inventor of the erected foldable transportable structure 10 according to the concepts of the present invention, and is further fully described at page 12, line 4 through page 14, line 14 above.

FIG. 20, containing alternate embodiments to FIG. 2, shows a cross section of the collapsed structure in its folded flat transportable configuration, and is further fully described at page 14 line 15 through page 15 line 5 above.

FIG. 21, an alternate embodiment to FIG. 3, shows the vertical layout for the Geometric Folding Pattern that formulates the static hinge-to-hinge pivot point centering relationship between the structure's adjacent individual panels, and establishes a guide to determine the finished panel widths or height dimensions for the floor panel 11, the wall panels 13, 14, 16 and 17, the roof panel 15, the gable wall panels 12 and 18, and the vertical short and long points for the gable wall panels 12 and 18, and is further fully described at page 15, line 6 through page 16, line 2 above.

Figure 37:
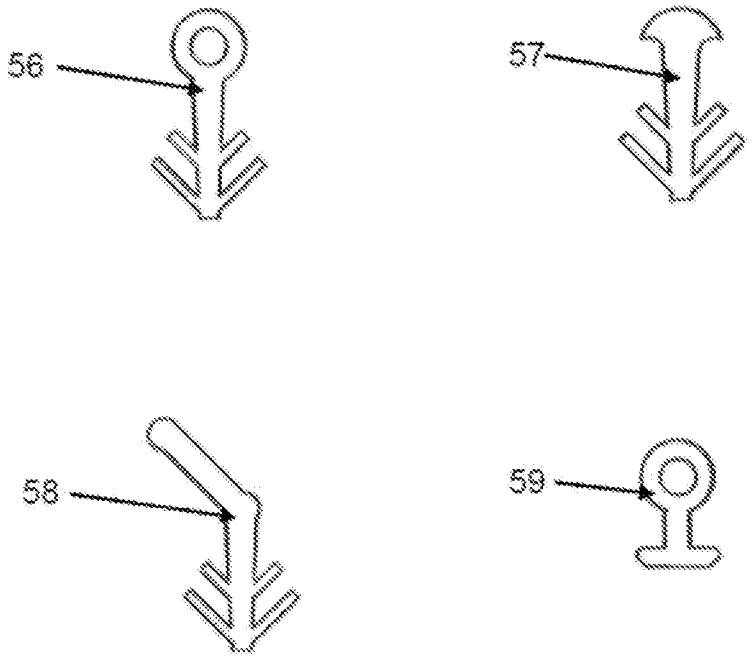
FIG. 37 is a sectional view of the alternate embodiment Weatherstrip, Corner Trim, Panel Hook and Door Seal components according to the present invention.

FIG. 22, an alternate embodiment to FIG. 4, shows a detail cross sectional view of the Roof Eave connector component 22. Roof Eave 22 as seen in FIG. 19 and FIG. 20, and similar to FIG. 23, is permanently attached to one long axis edge of the roof panel 15. Roof Eave 22 is always attached to the short wall upper panel assembly 14 with Dumbbell Hinge 21 as seen in FIG. 24, to create the low side of the roof slope for the fully erected structure 10 as can be seen in FIG. 19 and FIG. 20. The open hinge slots in Roof Eave 22 can receive a Dumbbell Hinge 21 as seen in FIG. 24 and FIG. 23 where hinging action is required, or can receive Weatherstrip 56, Corner Trim 57 or Panel Hook 58 as seen in FIG. 37 where required.

FIG. 23, an alternate embodiment to FIG. 5, shows a detail cross sectional view of the Roof Ridge to upper wall assembly, and the related hinging motion according to the present invention. The Roof Ridge connector component 23 is permanently attached to the roof panel 15 and connected to the adjacent wall 16 by Wall Hinge connector component 20 as seen in FIG. 26 and the separate continuous flexible Dumbbell Hinge connector component 21 as shown in FIG. 24. The open hinge slots in Roof Ridge 23 and Wall Hinge 20 can receive a Dumbbell Hinge 21 as seen in FIG. 24 where hinging action is required, or can receive Weatherstrip 56, Corner Trim 57 or Panel Hook 58 as seen in FIG. 37 where required.

FIG. 24, an alternate embodiment to FIG. 6, shows a detail cross sectional view of the structural and flexible continuous Dumbbell Hinge component 21 that is inserted with a sliding motion into the respective open hinge slots of the connector components 19, 20, 22 and 23 as seen in FIG. 22, FIG. 23, FIG. 25, FIG. 28 and FIG. 35. The Dumbbell Hinge component 21 provides the flexible hinging motion between connected adjacent panel assemblies for folding ability of the structure, and performs as a positive continuous weatherstrip between adjacent panels when the structure is in its fully erected configuration as seen in FIG. 19.

Figure 25:
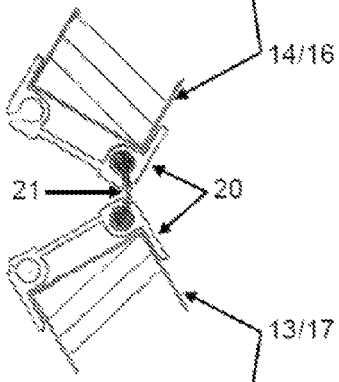
FIG. 25 is a sectional view of the wall to wall connected components containing alternate embodiments according to the present invention.

FIG. 25, containing alternate embodiments to FIG. 7, is a detail cross sectional view of the wall to wall middle hinged connection of the upper tall wall panel assembly 16 to the lower tall wall panel assembly 17, and the related hinging motion according to the present invention. The mid wall connection is also used between the lower and upper short wall panel assemblies 13 and 14 on the opposite side of the structure as seen in FIG. 19. The middle hinge assembly consists of two (2) each opposing separate continuous Wall Hinge connector components 20 as seen in FIG. 26 and permanently attached adjacent wall panel assemblies, connected together by the separate continuous flexible Dumbbell Hinge connector component 21 as seen in FIG. 24. The open hinge slots in Wall Hinges 20 can receive a Dumbbell Hinge 21 where hinging action is required, or can receive Weatherstrip 56, Corner Trim 57 or Panel Hook 58 as seen in FIG. 37 where required.

FIG. 26, an alternate embodiment to FIG. 8, shows a detail cross sectional view of Wall Hinge 20 that is permanently attached to the short axis ends of floor panel 11 and roof panel 15, and to all of the exposed edges of gable panels 12 and 18, wall panels 13, 14, 16 and 17 as seen in FIG. 1, FIG. 2, FIG. 17, FIG. 19, FIG. 20, FIG. 23, FIG. 25, FIG. 28 and FIG. 35, and to removable panel assemblies 24 as seen in FIG. 30 and FIG. 31. The open hinge slots in Wall Hinge 20 can receive a Dumbbell Hinge 21 as seen in FIG. 24 where hinging action is required, or can receive Weatherstrip 56, Corner Trim 57 or Panel Hook 58 as seen in FIG. 37 where required.

FIG. 27, an alternate embodiment to FIG. 9 shows a detail cross sectional view of the Floor Curb connector component 19, Floor Curb 22 as seen in FIG. 19 and FIG. 20 is permanently attached to each long axis edge of the floor panel 11 as seen in FIG. 28. The top half of Floor Curb connector component 19 is removed where removable panels 24 are located to create an opening flush to the floor panel 11. The open hinge slots in Floor Curb 19 can receive a Dumbbell Hinge 21 as seen in FIG. 24 where hinging action is required, or can receive Weatherstrip 56, Corner Trim 57 or Panel Hook 58 as seen in FIG. 37 where required.

FIG. 28, an alternate embodiment to FIG. 10, shows a detail cross sectional view of the Floor Curb to the lower wall assembly, and the related hinging motion according to the present invention. The Floor curb connector component 19 is permanently attached to the floor panel 11 and connected to the adjacent wall 17 by Wall Hinge connector component 20 as seen in FIG. 26 and the separate continuous flexible Dumbbell Hinge connector component 21 as shown in FIG. 24. The open hinge slots in Floor Curb 19 and Wall Hinge 20 can receive a Dumbbell Hinge 21 as seen in FIG. 24 where hinging action is required, or can receive Weatherstrip 56, Corner Trim 57 or Panel Hook 58 as seen in FIG. 37 where required.

FIG. 29, an alternate embodiment to FIG. 11, shows a perspective view showing the architectural horizontal grid pattern that establishes the structure's basic dimension design, and also facilitates specific aligned layout locations for removable wall panels, door and window assemblies for interchangeability between complexed units according to the present invention, and is further fully described at page 18, lines 15 to 20 above.

FIG. 30, an alternate embodiment to FIG. 12, shows a detail cross sectional view of the removable wall panel 24 components. A Wall Hinge 20 as seen in FIG. 26 is permanently attached to all edges of the removable panels as seen in FIG. 31. A semi-rigid Panel Hook 25 as seen in FIG. 37 is inserted into the relative Wall Hinge 20 slots to provide an interlocking weather seal around the perimeter of the removable panel 24 as seen in FIG. 31. A series of reclosable dual lock straps 26 as seen in FIG. 36 are engaged between the removable panel 24 and adjacent wall panels to secure the removable panel 24 assembly in place.

FIG. 31, containing alternate embodiments to FIG. 13, shows a perspective elevation of the assembled removable wall panel 24, and the locations of relative components.

Figure 32:
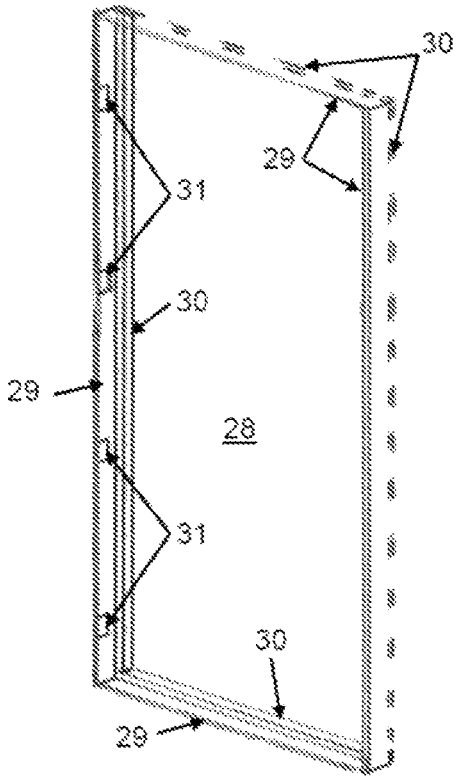
FIG. 32 is a perspective view of the FlexFrame Door assembly containing alternate embodiments according to the present invention.
Figure 34:
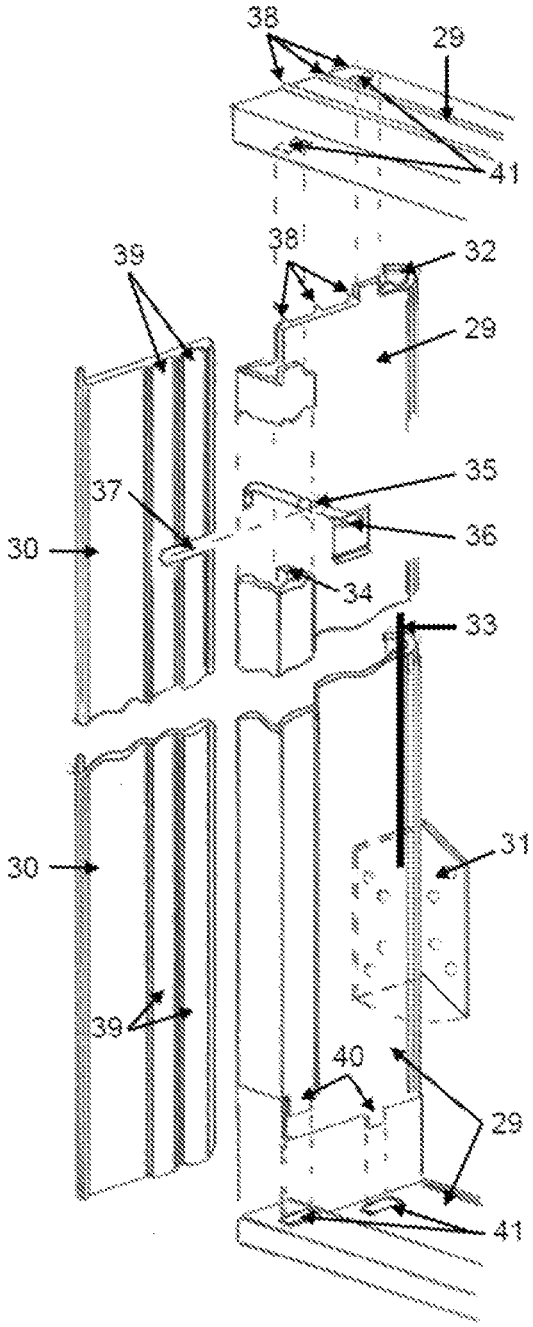
FIG. 34 is an exploded perspective elevation view of the alternate embodiment FlexFrame Door components according to the present invention.

FIG. 32, containing alternate embodiments to FIG. 14, shows a perspective elevation view of the overall configured door frame assembly 28 as seen in FIG. 19 which includes a series of separate adjustable interlocking jamb components 29 and 30, and a series of hinge components 31 as seen in FIG. 33 and FIG. 34.

FIG. 33, an alternate embodiment to FIG. 15, shows a detail cross section of the jamb components to include the following: a jamb component 29, with a series of 'V' shaped protrusions 38 running the length of the component, that is used for the side jambs, header and sill components; an interlocking jamb component 30, with a series of 'V' shaped grooves 39 running the length of the component that mate with the 'V' shaped protrusions 38 of jamb component 29, to allow overall jamb width adjustability to varying wall thickness widths; a series of latch spring-bolt and compression hook assemblies 36 for securing jamb components 29 and 30 together; and a hinge component 31 for attachment of the door 42 and door panel trim 43 to the side jamb component 29.

FIG. 34, an alternate embodiment to FIG. 16, shows a perspective cut-away elevation of the various door frame components to illustrate more specifically individual component relationships, details, and the reversible and invertible function of the door assembly. Jamb component 29 and separate hinge components 31 each include a round hollow profile 32, as can be more aptly seen in FIG. 33 on their respective outside edges that allow insertion of a continuous hinge securing rod 33 to attach the two components together. The single hinge-side jamb component 29 includes a series of cut-out sections to allow insertion of hinge components 31 and corresponding vertical alignment of their respective round hollow profiles 32. Side jamb, header and sill components 29 each include an extruded open slot to receive a continuous weatherstrip component 34, as can be more aptly seen in FIG. 33. Jamb components 29 include a series of holes 35 where either a thumb-turn threaded rod with compression nut or a latch spring-bolt compression hook locking assembly 36 is installed. Corresponding jamb components 30 include a series of open-ended slots 37 that align with the series of thru-bolts 36 installed on jamb components 29. Together components 36 and 37 allow for a sliding back and forth motion between jamb components 29 and 30 for adjustability to variable adjacent wall panel thicknesses. Jamb components 29 include a series of protruding 'V' shapes 38 that rest into a corresponding series of reverse retention 'V' shapes 39 that are integral to jamb components 30. Jamb components 29 and 30 are then prevented from sliding apart when tightened together with the latch spring-bolt and compression hook assembly 36. The two each side jamb components 29 each include on their ends a pair of male tabs 40 that fit into a corresponding pair of female slots 41 that are punched into the top surfaces of the header and sill components 29. The series of tabs 40 and slots 41 prevent potential horizontal movement between the two each side jamb components 29 and the header and sill components 29. The series of tabs 40 and slots 41 also allow the hinge-side jamb component 29 and attached door components 42 and 43 to be inverted between the header and sill components 29 in order to change the door to either a right or left handed swing function. The entire door assembly 28 is also installable on either the exterior or interior of the wall to additionally provide for any of the four each possible swing functions required. A structural insulated door panel 42 as seen in FIG. 33 is wrapped on all four side edges with a 'U' shaped trim cap component 43, and is attached with a series of fasteners 44 to a series of symmetrically centered surface mounted hinge components 31. A commercially available flush mounted latching and locking mechanism is installed in the door panel component 42 to complete the door assembly. Each of the door assembly components can be made from any variety or combination of metals, plastics, composites, fiber reinforced polymers, fiberglass or other types of material.

FIG. 35, an alternate embodiment to FIG. 17, shows a perspective cut-away view of the collapsed structure showing the adjustable strap conveyance and tie-down assembly, the adjustable leveling foot assembly, the spiral ground stake component, the fillable bladder bag component, and the relationship between components according to the present invention, and is further fully described in page 21, line 19 through page 22, line 16 above.

FIG. 36, an alternate embodiment to FIG. 18, shows a section and elevation view of the structural load compliant Reclosable Latch 26*a* as can be seen in FIG. 19 and FIG. 30 that is connected to the various adjacent panel assemblies to secure the panels from unhinging or being removed while the structure is in a fully erected configuration.

FIG. 37 shows sectional views of the Weatherstrip 56, Corner Trim 57, Panel Hook 58 and Door Seal 59 components according to the present invention.

The problems addressed by the Foldable Transportable Structure 10 are many as can be easily seen by those skilled in this art. The Foldable Transportable Structure 10 greatly enhances the ability and proficiency to deploy moveable structures and reduce transportation costs, by including a well-arranged series of structural panels, hinges and other components, which are connected together in a certain way that allows the structure to be folded down into a collapsed configuration to provide a very compact transportable structure. The Foldable Transportable Structure 10 supports easy and complete assembly in the field, especially in more remote locations, by not requiring the use of power, separate hand tools, or separate loose connectors and fasteners that can be misplaced or lost. The Foldable Transportable Structure 10 saves field time and labor costs by requiring only three to four unskilled persons less than five minutes to fully erect it, and it can also be as easily collapsed and re-deployed to a different location in as little time. The Foldable Transportable Structure 10 is environmentally responsible as all individual components are designed to provide more than just one integrated function, thus substantially reducing raw material quantities, environmental impact and production costs. The flexible design of the Foldable Transportable Structure 10 allows for choice of varying raw materials to meet fluctuating market conditions or any user required specifications. The design of the Foldable Transportable Structure 10 includes a Geometric Folding Pattern, as seen in FIG. 3 and FIG. 21 that provides folding ability of the structure, and also establishes or allows for: combination of varying panel thicknesses for the floor, wall and roof panels; the guided folding motion and cohesive interaction of each individual structure component; maintaining minimal clearances and continual structural support between all adjacent components during the folding process or transportable configuration. The Foldable Transportable Structure includes panel connector components that are multi-functional in that they can accept various flexible Dumbbell Hinge components or Weatherstrip, Corner Trim and Panel Hook components that are interchangeable and can be easily replaced in the assembled structure if they become damaged in the field. The Foldable Transportable Structure 10 provides additional value to the end user as units can be optionally equipped witty an integrated Removable Wall Panel system, as amply seen in FIGS. 11 through 13 and 29 through 31 to allow for the in-the-field switching of the door or window locations, or to create other clear opening locations for flexible flow-through configurations within multiple combined units. The Reversible FlexFrame Door assembly, as amply seen in FIGS. 14 through 16 and 32 through 34 saves raw materials and costs by providing a one-size-fits-all assembly. The Foldable Transportable Structure 10 will find wide use anywhere disaster relief, military, and other civil types of operations are required. Private industry would be employed to manufacture the many units required.

Thus it will be appreciated by those skilled in the art that the present invention is not restricted to the particular preferred embodiments described with reference to the drawings, and that variations may be made therein without departing from the scope of the present invention as defined in the appended claims and equivalents thereof.

What is claimed is:

1. A foldable transportable structure for human occupation or storage, comprising: a geometric folding pattern; at least one continuous pivot hinge-to-panel system; at least one removable wall panel system; at least one adjustable reversible any-swing door, frame and threshold assembly; at least one adjustable dual-function pad leveler and stacking guide system; at least one attached multi-function conveyance and tie-down strap and hook system; at least one bladder bag ballast assembly; wherein said structure has a series of continuous pivot hinge-to-panel connectors further comprising: a variety of panel-to-panel connectors of which each is manufactured as one extruded, pultruded or combined unified component, and is comprised of two each various shaped panel edge cap shapes with a continuous articulating hinge integrally attached between them, each said connector further including a variety of component dimensions and can be made of a variety of materials such as plastics, metals, resins, composites or other materials; a separate floor panel-to-curb component of sufficient dimensions to be able to receive a floor panel and a continuous pivot hinge wall-to-wall connector component; a separate continuous pivot hinge wall-to-wall connector component for the attachment of two wall panels together, or a wall to the floor curb component; a separate roof ridge-to-wall connector component for the attachment of the roof panel to the top panel of the tall wall assembly, inclusive of an integrated built up 5 mm curb leveling pad containment section on the top part of the component, to provide sliding containment for leveling pads of another structure when it is placed on top of said collapsed structure, and alternately provides secure hook capture for the strap tie-down system when the said structure is in its collapsed transportable configuration; a separate roof eave-to-wall connector component for the attachment of the roof panel to the top panel of the short wall assembly, inclusive of an integrated built up 5 mm curb leveling pad containment section on the top part of the component, to provide sliding containment for leveling pads of another structure when it is placed on top of said collapsed structure, and alternately provides secure hook capture for the strap tie-down system when the said structure is in its collapsed transportable configuration.

2. The foldable transportable structure according to claim 1 wherein said geometric foldable pattern further comprises: a geometric foldable pattern for calculating accurate finished panel dimensions for: a floor panel expressed as 'A' with an arbitrarily chosen width dimension being designated as 'X', a bottom short wall panel expressed as 'B' being of a height that is relative to 41.27617% of 'X', an upper short wall panel expressed as 'C' being of a height that is relative to 43.27018% of 'X', a bottom tall wall panel expressed as 'D' being of a height that is relative to 55.63310% of 'X', an upper tall wall panel expressed as 'E' being of a height that is relative to 57.76271% of 'X', a roof panel expressed as 'F' that is of a width that is relative to 103.98803% of 'X', a pair of gable panels expressed as 'G' that are of a width that is relative to 99.70089% of 'X', a pair of gable panels expressed as 'G' with a short point height that is of a length that is relative to 84.24725% of 'X' plus the chosen thickness width of the wall panels, a pair of gable panels expressed as 'G' with a tall point height that is of a length that is relative to 112.96111% of 'X' plus the chosen thickness width of the wall panels.

3. The foldable transportable structure according to claim 2 wherein said geometric folding pattern further comprises: the floor panel expressed as 'A' with an arbitrarily chosen width dimension being designated as 'X' is in the range of not less than 1800 mm (=4.9' headroom low side) and not more than 2070 mm, thus limiting the structure's overall finished dimensions to maintain: adequate low side interior head clearance; adequate gable wall vertical length for installation of an exterior door of sufficient useable height; a collapsed maximum total width for ability to fit into and out of internationally standardized modal transportation openings.

4. The foldable transportable structure according to claim 2 wherein said geometric folding pattern further comprises: a horizontal length limit for the total finished three dimensional structure to be not less than 1200 mm, thus limiting the structure's overall finished dimensions.

5. The foldable transportable structure according to claim 2 wherein said geometric folding pattern further comprises: a horizontal length limit of the total finished three dimensional structure to be not less than 1200 mm and not more than 5892 mm, thus limiting the structure's overall finished dimensions.

6. The foldable transportable structure as in claim 1 wherein said structure has a removable pop-out/pop-in wall panel assembly system further comprising: a strategic grid located series of removable walls panels that match the hinging profile of the tall side wall panels, each said panel further including a special shaped interlocking panel edge cap, a series of pivot hinge-to-panel connectors, an integrated removable window panel section, and an integrated removable bottom curb section.

7. The foldable transportable structure as in claim 1 wherein said structure includes an adjustable reversible any-swing door, frame and threshold assembly comprising: an assembly of separate components that include a jamb, header, threshold sill, door panel, weather-strip, hinges, finger-turn jamb locking mechanism, and an entry locking mechanism of which each can be made of a variety of materials such as plastics, metals, resins, composites or other materials, and that when combined together provide a fully adjustable door assembly that is able to conform to any wall thickness and to any swing configuration desired, without the requirement of separate fasteners or tools for installation.

8. The foldable transportable structure as in claim 1 wherein said structure includes a series of adjustable leveling pads also described as a dual-function pad leveler and stacking guide system, that provides adjustment to the level of the structure by a simple turning function of a threaded leveling rod and attached pad component, and alternately provides a mechanism for sliding and containing stacked structures on top of another for shipping, and comprises: an assembly of separate components that include a hollow tube, leveling tube adapter, threaded rod with attached foot of which each can be made of a variety of materials such as plastics, metals, resins, composites or other materials, and that when combined together provide a fully adjustable structure leveling assembly without the requirement of separate tools for adjustment.

9. The foldable transportable structure as in claim 1 wherein said structure includes a series of attached straps with adjusting capabilities also described as a multi-function conveyance and tie-down strap and hook system, that comprises: at least one each single continuous strap that can be made of a variety of materials such as cotton, silk, nylon, polypropylene, polyester, hemp, polyurethane, Nomex, Kevlar, composites or other materials, and is attached to the structure in a way to simultaneously provide a fixed looped handle configuration for conveyance, and an extending adjustable tie-down strap and hook system for structural tie-down of the structure when it is in either a collapsible or erected configuration.

10. The foldable transportable structure as in claim 1 wherein said structure includes a fillable bladder bag, that comprises; at least one load compliant pliable bladder bag that can be made of a variety of materials such as rubber, synthetic rubber, nylon, polypropylene, polyurethane, composites or other materials, and that becomes attached to the tie-down strap and hook system to provide sufficient additional weight to the structural tie-down assembly.

11. The foldable transportable structure as in claim 10 wherein said structure includes a fillable bladder bag, that comprises: at least one load compliant ballast bag that can be either rolled or folded up to fit inside the strategically provided voids within the collapsed structure, and when deployed provides a series of integral eyelets for receiving the hook component of the tie-down strap and hook system and additional spiral earth anchor components if required, and is then filled with a pourable material that can be made of water, sand, gravel, or other material through a top mounted opening with a removable apparatus.

* * * * *